US005784892A

United States Patent [19]

Reedy

[11] Patent Number: 5,784,892

[45] Date of Patent: Jul. 28, 1998

[54] REFRIGERANT CHARGE VARIATION MECHANISM

[75] Inventor: Wayne P. Reedy, Edwardsville, Ill.

[73] Assignee: Electric Power Research Institute, Inc., Palo Alto, Calif.

[21] Appl. No.: 708,810

[22] Filed: Sep. 9, 1996

[51] Int. Cl.[6] ..... F25B 41/00

[52] U.S. Cl. ..... 62/174; 62/324.4

[58] Field of Search ..... 62/174, 324.4

[56] References Cited

U.S. PATENT DOCUMENTS

| | | | |
|---|---|---|---|
| 3,238,737 | 3/1966 | Shrader et al. | 62/174 |
| 3,736,763 | 6/1973 | Garland | 62/174 |
| 5,140,827 | 8/1992 | Reedy | 62/174 |
| 5,477,697 | 12/1995 | Wharton et al. | 62/174 |

*Primary Examiner*—William E. Tapolcai
*Attorney, Agent, or Firm*—Harris Beach & Wilcox, LLP

[57] ABSTRACT

A heat pump system capable of heating and cooling an indoor space includes a refrigerant compressor having a discharge side and a suction side interconnected with respective indoor and outdoor heat exchanger coils via a reversing valve, and a condensed refrigerant line interconnecting the indoor and outdoor heat exchangers. Refrigerant charge can be variably added or taken away from the system based on operating conditions using a refrigerant reservoir having a flow regulated first valve connected to the condensed refrigerant line and a similar second valve connected to the suction side. A flow regulated third valve is used to bleed vapor from the reservoir to lower the pressure of refrigerant contained therein relative to the pressure in the liquid line.

5 Claims, 2 Drawing Sheets

REFRIGERANT CHARGE VARIATION MECHANISM

BACKGROUND OF THE INVENTION

This invention relates to air conditioner and heat pump systems, and in particular to a combined heat pump and hot water system that provides heating or cooling to an indoor space having an improved refrigerant charging mechanism to vary the amount of refrigerant charge in the system based on loading conditions.

Commonly assigned U.S. Pat. No. 5,140,827 describes a heat pump system having a charge adjustment arrangement that varies the amount of refrigerant charge in the system in response to changes in operating conditions, i.e., changes in load, of the heat pump system.

In particular, this reference describes a heat pump system having a refrigerant receiver which is selectively connected to the liquid line via a first actuable valve, or to the suction side of a compressor via a second actuable valve. The actuable valves can be, for example, solenoid valves.

When connected to the liquid line, refrigerant will be transferred into the receiver, and the compressor discharge temperature will increase. Alternately, and when connected to the suction side of the compressor, refrigerant will be transferred out of the receiver, causing the compressor discharge temperature to decrease. Therefore, by monitoring the compressor discharge temperature, refrigerant can be added or deleted from the operating system to maximize performance.

For the described system to function efficiently, however, the pressure in the refrigerant receiver must be greater than that in the suction line and less than that in the liquid line. It has been discovered that this occurs under most known conditions, with the exception of low ambient heating operations, e.g. at about 0° F.

There is a need to insure the efficiency of the described heat system by extending the operating range thereof.

SUMMARY OF THE INVENTION

It is accordingly a primary object of the present invention to provide a combined heat pump system having improved means for adjusting the active refrigerant charge in order to improve performance over an extended range of conditions, and therefore under literally all known operating conditions.

It is a more specific object to provide a refrigerant charge adjustment means which is reliable, and simple to implement without any significant cost impact or increase in the footprint of an existing system.

In accordance with a preferred aspect of the present invention, there is provided a heat pump system capable of heating and cooling an indoor space, comprising:

a refrigerant compressor having a discharge port for discharging compressed refrigerant vapor and a suction port for returning low pressure refrigerant vapor to the compressor;

indoor and outdoor heat exchangers, each having respective heat exchanging coils having first and second refrigerant ports, and indoor and outdoor expansion devices respectively coupled to said second refrigerant ports;

a reversing valve having a first port coupled by a pressure line to the discharge port of said compressor, a second port coupled by a suction line to the suction port of said compressor, and third and fourth ports coupled respectively to the first ports of said indoor and outdoor heat exchanger coils; said reversing valve having a heating position in which the compressed refrigerant is supplied to the indoor coil and the low pressure vapor is returned from the outdoor coil, and a cooling position in which compressed refrigerant is supplied to the outdoor coil and the low pressure vapor is returned from the indoor coil;

a condensed refrigerant line interconnecting said indoor and said outdoor heat exchangers for supplying condensed refrigerant from one of said heat exchanger coils to the expansion device of the other heat exchanger; and refrigerant charge variation means for varying the amount of refrigerant in the system based on operating conditions, including:

a refrigerant reservoir, having a first branch connected to the condensed refrigerant line and a second branch, separate from said first branch, connected to the suction line, said first and second branches including respective first and second valves and flow restrictor elements connected in series;

means coupled to the pressure line for detecting the amount of thermal energy of the compressed refrigerant being discharged from said compressor;

means for actuating said first and second valves based on the thermal energy of the compressed refrigerant in order to transfer refrigerant from the condensed refrigerant line to the reservoir when said thermal energy is below a predetermined level and to transfer refrigerant from said reservoir to said suction line when said thermal energy is above a predetermined level; and means for lowering the pressure of refrigerant contained in said refrigerant reservoir when the pressure in said reservoir is higher than the pressure of condensed refrigerant in said pressure line.

According to a preferred embodiment of the present invention, the pressure lowering means includes a third actuable valve connected to an upper portion of the refrigerant reservoir, the third valve being selectively or automatically actuable to draw refrigerant vapor from the reservoir in order to lower the pressure therein.

An advantage achieved by providing a heat pump system having the enhanced refrigerant charge variation valving arrangement is that the system can be used in almost all known conditions, including low ambient heating.

These and other advantages, features, and objects will be more fully understood from the following the description of the preferred embodiments, which should be read in accordance with the accompanying drawings.

DETAILED DESCRIPTION OF THE PREFERRED EMBODIMENTS

Figure 1:
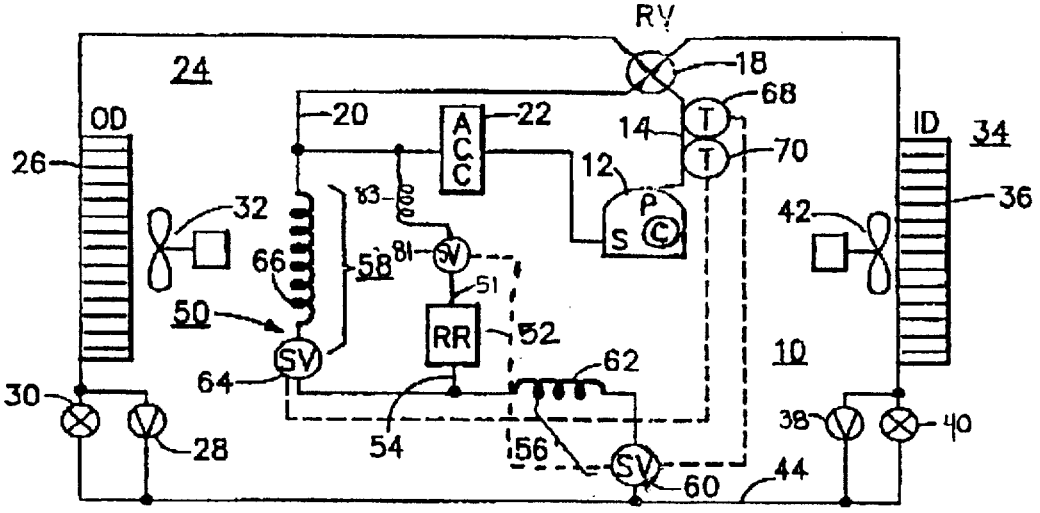
FIG. 1 is a schematic flow diagram of a combined heat pump system according to a first embodiment of the present invention.

Referring first to FIG. 1, a known heat pump system 10 is shown and described herein which includes a refrigerant compressor 12 capable of pumping a refrigerant fluid at a desired operating temperature and pressure. The compressor 12 receives low pressure vapor at a suction port S and discharges compressed refrigerant at a discharge or pressure port P. The discharge port P supplies hot compressed refrigerant through a discharge line 14 to a four-way reversing valve 18. The reversing valve 18 has four connections or ports, one of which is connected to the discharge line 14 and another of which is connected through a suction line 20 to the suction port S of the compressor 12. An accumulator or dryer 22 is interposed ahead of the compressor 12 to intercept liquid or moisture that might be present in the refrigerant fluid in the suction line 20.

The remaining two ports of the reversing valve 18 connect to an outdoor heat exchanger 24 and an indoor heat exchanger 34, respectively, each described in greater detail below. The reversing valve 18 has a cooling or air conditioning position and a heating position. In the cooling position, the outdoor heat exchanger 24 serves as the condenser while the indoor heat exchanger 34 serves as the evaporator. In the heating position, the indoor heat exchanger 34 serves as the condenser and the outdoor heat exchanger 24 serves as the evaporator. The reversing valve 18 can be of any suitable known design.

The outdoor heat exchanger 24 comprises an outdoor evaporator/condenser coil 26 that is connected at one end to the reversing valve 18 and at the other end to a check valve 28 and an expansion device 30 positioned in parallel with one another. An outdoor fan 32 forces outdoor air over the heat exchanger coil 26 for transfer of heat between the refrigerant in the coil 26 and the outdoor air.

An indoor heat exchanger 34 comprises an indoor evaporator/condenser coil 36 that is connected at one end to the reversing valve 18 and at the other end to a check valve 38 and expansion device 40 connected in parallel with each other. An indoor fan 42 forces air from the indoor comfort and living space over the coil 36, for transfer of heat between the indoor air and the refrigerant in the coil 36.

A condensed refrigerant line or liquid line 44 connects the two heat exchangers 24 and 34. In the heating mode, condensed refrigerant flows from the indoor coil 36, through the check valve 38 and liquid line 44, and then sequentially through the expansion device 30 into the outdoor heat exchanger coil 26. When the reversing valve 18 is set to place the system 10 into a cooling mode, the condensed refrigerant flows from the outdoor coil 26, through the check valve 28 and the liquid line 44, and subsequently through the expansion device 40 into the indoor heat exchanger coil 36.

A refrigerant charge adjustment arrangement 50 is provided for automatically adding refrigerant to or removing refrigerant from the described active heat pump elements depending on the operating environment; in this embodiment, depending on the temperature of the compressed refrigerant vapor that leaves the discharge port P of the compressor 12. A refrigerant reservoir 52 includes an inlet/outlet port 54 disposed on a lower end, an inlet branch 56 connecting the inlet/outlet port 54 to the liquid refrigerant line 44 and a discharge branch 58 connecting the reservoir port 54 to the suction line 20. The inlet branch 56 comprises a solenoid or equivalent valve 60 which is connected in series with a flow restrictor 62, such as a capillary tube. The discharge branch 58 also comprises a solenoid or equivalent valve 64 in series with a flow restrictor 66, such as a capillary tube. First and second thermostats 68, 70 are disposed in thermal contact with the compressed refrigerant vapor in the discharge line 14, for actuating the solenoid valves 60, 64, respectively, via control lines (shown as dotted lines per FIG. 1). The two thermostats 68, 70 are sensitive to respective temperatures $T_1$, $T_2$. Thermostat 68 opens the valve 60 when the discharge temperature is below $T_1$, and thermostat 70 opens the valve 64 when the discharge temperature exceeds temperature $T_2$.

If the compressor discharge temperature drops below $T_1$; for example, 170° F., the solenoid valve 60 opens to admit a small flow of liquid refrigerant into the reservoir 52. The rate of flow is controlled by the capillary tube 62, or a similar restrictor, meaning some condensed refrigerant from the flow in the liquid line 44. The removal of a small amount of refrigerant from the operating system reduces the subcooling of the liquid refrigerant. For a typical heat pump system, the expansion devices 30, 40, which can be fixed or variable type orifices, or in some cases a capillary, are sensitive to inlet subcooling. The result of removal of some of the refrigerant to the reservoir 52 is to reduce the total system refrigerant flow rate. This, in turn, increases the refrigerant superheat for the vapor leaving the evaporator coil and entering the compressor 12. This consequently increases the compressor discharge temperature.

When the compressor discharge temperature increases to a level above temperature $T_1$, the solenoid valve 60 shuts off and stops the transfer of refrigerant to the reservoir 52.

On the other hand, if the discharge refrigerant temperature exceeds the thermostat temperature $T_2$, for example, 190° F., the solenoid valve 64 opens, and permits a small flow of refrigerant as modulated by the capillary 66, or similar restrictor out of the reservoir 52, which is at an intermediate pressure, into the suction line 20 which is at a low pressure. This flow of refrigerant adds to the operating system charge, thus increasing subcooling, reducing superheat and consequently reducing the compressor discharge temperature. When the resulting discharge temperature drops below temperature $T_2$, the solenoid valve 64 closes. The features of the system as described thus far are provided in commonly assigned U.S. Pat. No. 5,140,827, the contents of which are hereby incorporated by reference in their entirety.

As noted above, this heat pump system 10 for the sake of efficiency requires that the pressure within the refrigerant reservoir 52 be less than that in the liquid line 44 and greater than that in the suction line 20. This is normally true for nearly all possible conditions, with the exception of extremely low ambient heating operations, for example when the temperature of the outdoor air is approximately 0° F. or lower.

Still referring to FIG. 1, a third solenoid or other suitably actuable valve 81 is connected to an upper portion 51 of the refrigerant reservoir 52 along with a capillary tube 83, or similar flow restrictor which are connected together in series. The third valve arrangement is connected to the suction line 20 as shown and preferably in advance of the interposed accumulator 22.

When opened, the solenoid valve 81 can bleed a small amount of vapor contained within the upper portion 51 of the refrigerant reservoir 52 into the suction line 20, the amount of flow being controlled by capillary tube 83, and therefore lower the pressure in the reservoir so that the reservoir will always be at a lower pressure than the liquid line 44 for all conditions. For simplicity of control, the vapor solenoid valve 81 and solenoid valve 60 are opened and closed in tandem, though alternate control means can be imagined. A control line is shown in phantom.

Figure 2:
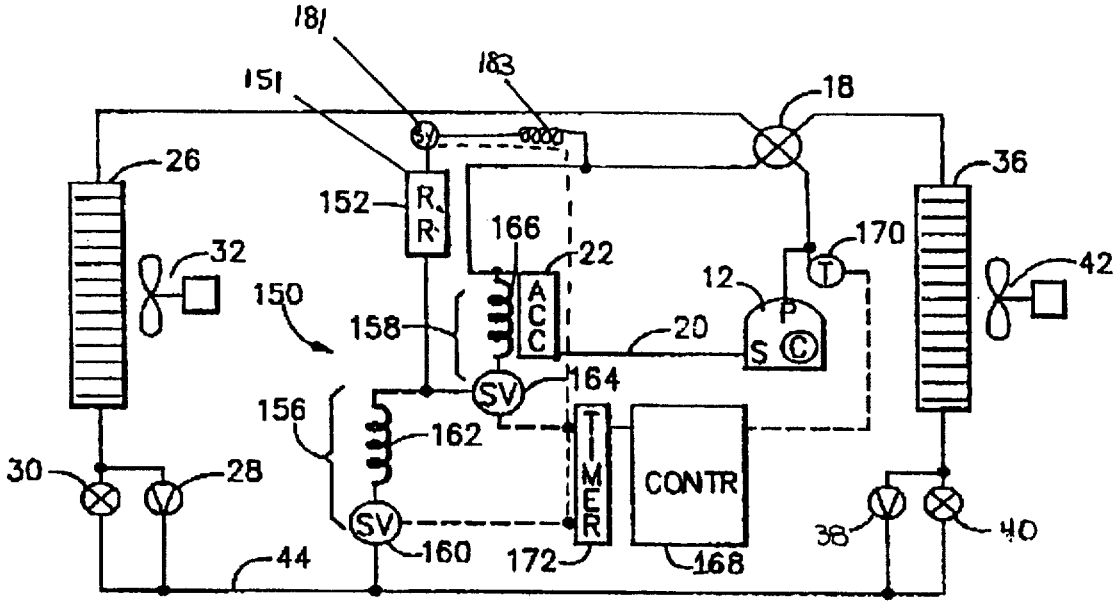
FIG. 2 is a schematic flow diagram of a combined heat pump system according to a second embodiment of the present invention.

A second embodiment is shown in FIG. 2, in which like elements are identified with the same reference numerals for the sake of clarity.

A charge adjustment arrangement 150 includes a refrigerant reservoir 152 with an inlet branch 156 comprised of a solenoid valve 160 and a flow restrictor such as a capillary tube 162, and a discharge branch 158 comprised of a solenoid valve 164 and a flow restrictor 166. A separate third solenoid 181 and flow restrictor 183 are connected in series to the upper portion 51 of the reservoir 152 to bleed off refrigerant vapor to lower the pressure of the reservoir, the vapor being bled into the suction line 20.

A controller circuit 168 has an input terminal connected to a temperature sensor 170, such as a thermistor, in thermal contact with the discharge port P of the compressor 12, and outputs (not shown) coupled to actuate the solenoid valves 160, 164 and 181. A time delay circuit 172 can also be incorporated in the circuit as shown to prevent the charge adjustment arrangement 150 from being actuated for a predetermined time after start up of the compressor 12 to permit the system to stabilize.

The arrangement of FIG. 2 permits a different pair of temperatures to control withdrawal and addition of refrigerant fluid for heating and cooling; or to change the value of the two threshold temperatures $T_1$, $T_2$, as a function of one or more outdoor temperature, indoor temperature, coil temperature, suction pressure, discharge pressure, reservoir pressure, liquid line pressure, etc.

Figure 3:
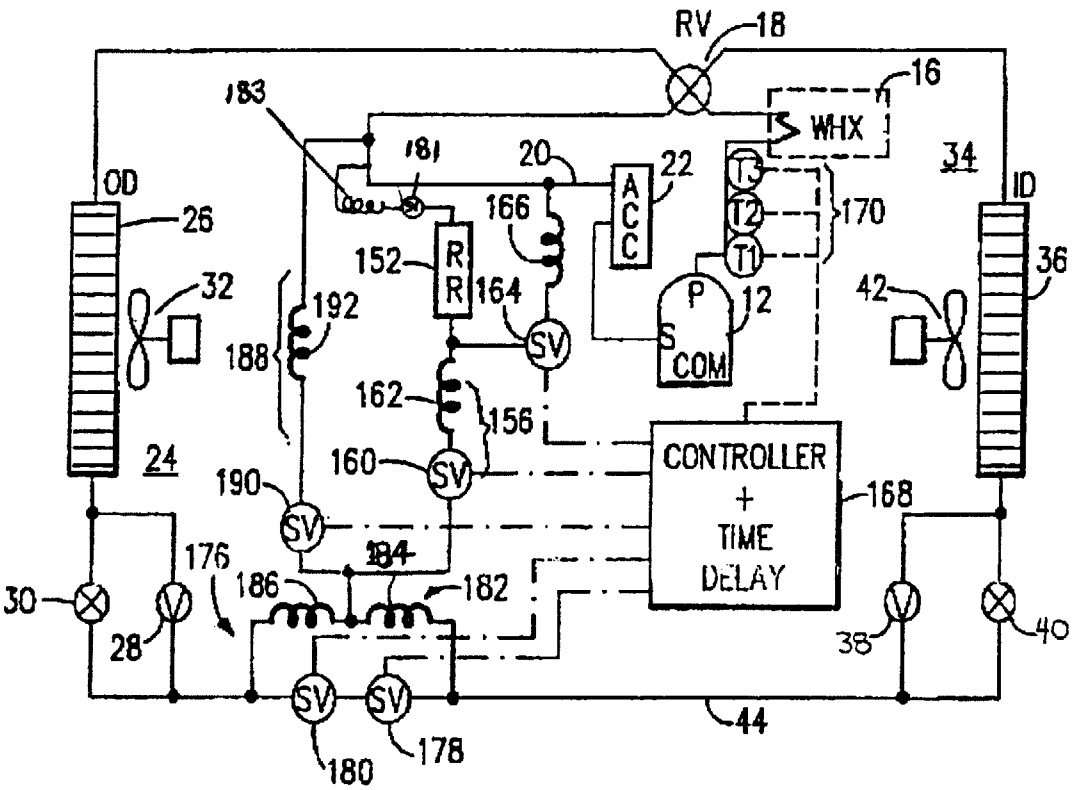
FIG. 3 is a schematic flow diagram of a heat pump system according to a third embodiment of the present invention.

FIG. 3 illustrates a third embodiment involving an integrated heat pump and hot water system capable of providing space heating, space cooling, and heating of water. As the preceding embodiment, similar parts are identified with the same reference numerals.

A water heat exchanger 16 is interposed in the discharge line 14 between the compressor discharge port P and the reversing valve 18. The water heat exchanger 16 transfers heat from the compressed refrigerant to water which is then supplied to a domestic water heating tank (not shown). The integrated heat pump system includes a selective flow restriction arrangement 176 interposed in the liquid refrigerant line 44 between the outdoor and indoor heat exchangers 24, 34. According to this embodiment, and in addition to solenoid valves 160, 164, and 181, there is a main, unrestricted flow branch comprised of a pair of solenoid valves 178, 180 arranged back to back and a restricted flow branch 182 comprised of a corresponding pair of flow restrictors 184, 186 connected in series and bridging the solenoid valves 178, 180. A quenching branch line 188 comprised of another solenoid valve 190 and flow restrictor 192 in series connects between the function of the flow restrictors 184, 186 and the suction line 20 in advance of the accumulator 22. The purpose and function of the selective flow restriction arrangement 176 and the branch line 188 which is to adjust the effective compressor capacity for water heating without space heating or cooling is discussed in greater detail in commonly owned and assigned U.S. Pat. No. 5,172,564 which is hereby incorporated by reference.

The controller 168 has outputs to control the solenoid valves 178, 180, and 190, in addition to the three solenoid valves 160, 164, and 181. The temperature sensor 170 is coupled to the controller 168 to actuate the solenoid valves 160, 164 and 181 at temperatures $T_1$ and $T_2$ for room cooling and heating modes, as discussed previously, or to separately actuate valve 181 if a pressure sensor (not shown) indicates that the pressure in the reservoir is too high in comparison with the liquid line 44. However, for a dedicated water heating mode, i.e., water heating only without space heating or cooling, an additional discharge line temperature $T_3$ above temperature $T_2$ may be employed to actuate the valve 160 so as to provide additional discharge superheat to the water heat exchanger 16.

While this invention has been described in detail to certain selected embodiments, it should be readily apparent that the invention should not be so limited. That is, many modification and variations are possible within the spirit of the scope of the invention.

What is claimed is:

1. A heat pump system capable of heating and cooling an indoor space, comprising:

a refrigerant compressor having a discharge port for discharging compressed refrigerant vapor and a suction port for returning low pressure refrigerant vapor to the compressor;

indoor and outdoor heat exchangers, each having respective heat exchanging coils having first and second refrigerant ports, and indoor and outdoor expansion devices respectively coupled to said second refrigerant ports;

a reversing valve having a first port coupled by a pressure line to the discharge port of said compressor, a second port coupled by a suction line to the suction port of said compressor, and third and fourth ports coupled respectively to the first ports of said indoor and outdoor heat exchanger coils; said reversing valve having a heating position in which the compressed refrigerant is supplied to the indoor coil and the low pressure vapor is returned from the outdoor coil, and a cooling position in which compressed refrigerant is supplied to the outdoor coil and the low pressure vapor is returned to the indoor coil;

a condensed refrigerant line interconnecting said indoor and said outdoor heat exchangers for supplying condensed refrigerant from one of said heat exchanger coils to the expansion device of the other heat exchanger; and refrigerant charge variation means for varying the amount of refrigerant in the system based on operating conditions, including:

a refrigerant reservoir, having a first branch connected to the condensed refrigerant line and a second branch, separate from said first branch, connected to the suction line, said first and second branches including respective first and second valves and flow restrictor elements connected in series;

means coupled to the compressor discharge line for detecting the amount of thermal energy of the compressed refrigerant being discharged from said compressor;

means for actuating said first and second valves based on the thermal energy of the compressed refrigerant in order to transfer refrigerant from the condensed refrigerant line to the reservoir when said thermal energy is below a predetermined level and to transfer refrigerant from said reservoir to said suction line when said thermal energy is above a predetermined level; and means for lowering the pressure of refrigerant contained in said refrigerant reservoir when the pressure in said reservoir is higher than the pressure of condensed refrigerant in said pressure line.

2. A system as claimed in claim 1, wherein said pressure lowering means includes a third actuable valve connected to said reservoir, said third valve being actuable to draw refrigerant vapor therefrom in order to lower the pressure in said reservoir.

3. A system as claimed in claim 2, wherein said first valve and said third valve are opened by said actuating means in order to open said valves simultaneously.

4. A system as recited in claim 3, including sensing means for sensing the pressure of refrigerant in said reservoir and in said pressure line, said sensing means being connectable to said actuating means to open said third valve in tandem with said first valve only when the pressure in said reservoir is greater than the pressure in said pressure line.

5. A system as recited in claim 1, wherein said detecting means includes at least one thermostat coupled to said first and second valves to open said first valve when the temperature of said pressure line is below a first predetermined temperature and to open the second valve when the temperature of the pressure line is above a second predetermined temperature.

* * * * *